US011617935B2

(12) United States Patent
Jones

(10) Patent No.: US 11,617,935 B2
(45) Date of Patent: Apr. 4, 2023

(54) BAG TOSS GAME BOARD WITH SCORE TRACKING

(71) Applicant: David P. Jones, Columbus, OH (US)

(72) Inventor: David P. Jones, Columbus, OH (US)

( * ) Notice: Subject to any disclaimer, the term of this patent is extended or adjusted under 35 U.S.C. 154(b) by 120 days.

(21) Appl. No.: 16/942,870

(22) Filed: Jul. 30, 2020

(65) Prior Publication Data

US 2021/0031092 A1 Feb. 4, 2021

Related U.S. Application Data

(60) Provisional application No. 62/880,858, filed on Jul. 31, 2019.

(51) Int. Cl.
*A63B 71/06* (2006.01)
*A63B 67/06* (2006.01)

(52) U.S. Cl.
CPC ..... *A63B 71/0672* (2013.01); *A63B 67/06* (2013.01); *A63B 2071/0694* (2013.01); *A63B 2209/08* (2013.01); *A63B 2209/10* (2013.01)

(58) Field of Classification Search
CPC . A63B 71/0672; A63B 63/00; A63F 3/00041; A63F 3/00
See application file for complete search history.

(56) References Cited

U.S. PATENT DOCUMENTS 2,108,527 A * 2/1938 Cudmorearthurh ..... A63F 1/06 235/90
3,526,403 A * 9/1970 Clark ..... A63F 3/00041 235/89 R
3,730,528 A * 5/1973 Corrado ..... A63F 3/00041 273/285
5,025,748 A * 6/1991 Pettis ..... A63F 11/0051 273/DIG. 26
5,664,782 A * 9/1997 Lacks ..... F41J 3/0028 273/408
6,464,224 B1 * 10/2002 Wusterbarth ..... A63F 3/00041 273/277
2002/0105140 A1 * 8/2002 Field ..... A63F 3/0005 273/245

(Continued)

OTHER PUBLICATIONS

Pinterest, Easy, Quick Answers About Woodworking Are Here, webpage, woodworkingadvice.info, Jul. 23, 2020, 2 pages.

(Continued)

*Primary Examiner* — Eugene L Kim
*Assistant Examiner* — Christopher Glenn
(74) *Attorney, Agent, or Firm* — Standley Law Group LLP; Jeffrey S. Standley; Adam J. Smith

(57) ABSTRACT

A game board for playing a bag toss game and methods for playing and scoring the same are provided. A playing surface includes a hole located at a distal half thereof and sized to receive a bag tossed therethrough. A leg located at a distal half of the game board permits angling the playing surface relative to a ground surface. A scoring indicator is selectively attachable to a number of attachment mechanism provided at a series of locations along the playing surface. Scoring lines are provided at the game board in association with the attachment mechanism so that the scoring indicator may be secured adjacent to one of the scoring lines to indicate a current score of the bag toss game.

17 Claims, 8 Drawing Sheets

(56) References Cited

U.S. PATENT DOCUMENTS

| | | | | |
|---|---|---|---|---|
| 2013/0082442 | A1* | 4/2013 | Hanel | A63B 67/06 273/398 |
| 2013/0168924 | A1* | 7/2013 | Poulos | A63F 3/00041 273/247 |
| 2018/0207503 | A1* | 7/2018 | Rivard | A63B 63/00 |

OTHER PUBLICATIONS

West Georgia Cornhole, Built in Scoreboard, webpage, Jul. 23, 2020, 2 pages.

* cited by examiner

BAG TOSS GAME BOARD WITH SCORE TRACKING

CROSS-REFERENCE TO RELATED APPLICATION

This application claims the benefit of U.S. Provisional Patent Application Ser. No. 62/880,858 filed Jul. 31, 2019, the disclosures of which are hereby incorporated by reference as if fully restated herein.

TECHNICAL FIELD

Exemplary embodiments of the present invention relate generally to systems and methods for tracking scores during a bag toss game.

BACKGROUND AND SUMMARY OF THE INVENTION

When attending any sort of event, such as, but not limited to, a sporting event, cookout, or graduation, it is common to find various lawn games available for guests to play. One such lawn game is a bag tossing game sometimes referred to as "cornhole", "bags", "sack toss", or "bean bag" which generally features four players, 8 bean bags, and two game boards that are propped up by legs at the top of each board to place the game board at a slightly elevated angle.

Each player takes turns throwing one of the four bean bags on behalf of their team at the opposite game board. Each bag may come to rest off of the opposite game board, on the opposite game board, or pass through the hole at the top of the opposite game board. In one version of this popular game, where a bean bag passes through the hole at the top of the board the player receives three points, where the bag lands and comes to rest on the board (having not passed through the hole), the player receives one point, and where the bag comes to rest off of the board, but has not passed through the hole at the top of the board, the player receives no points. After one round of tossing all eight bags, a score is calculated for each team based on the number of points received. In some versions of the game, a player may cancel an opponent's points with their points earned. For example, without limitation, if Team A puts one bag in the hole and two bags on the board that team would normally earn 5 points. If Team B fails to put a bag in the hole and places all four bags on the board, they would normally earn 4 points. However, when tallying up points for that round, Team A would receive only 1 point in this example as Team B landed four of their bags on the board, thereby earning four points which cancelled four of the five points earned by Team A.

The complex scoring method of this and similar variations of this popular lawn game often results in confusion, misstated scores, and generally causing players to experience difficulty in remembering the score of an ongoing game, which may result in frustration, arguments, or a lack of desire to continue play. Players typically have to rely upon their memory as to how many points each team has at any time during the game. The present invention includes a bag toss game board with one or more scoring features.

Exemplary embodiments of the present invention comprise an attachable scoring indicator for tracking ongoing game scores. The scoring indicator may be attached to the board by way of a slot or holes, for example without limitation. Such slot or holes may be provided in a side of the board and may be configured to hold one or more scoring indicators in place.

Exemplary embodiments of the present invention may include, alternatively or additionally, scoring lines placed on the bag toss game board. Similar to a football field, for example, simulated horizontal yard lines may be added to the game board. These scoring lines may be provided from near the proximal end to near the distal end (by the hole) of the game board. Such scoring lines may be provided, for example, on a playing surface for the game board, on a side surface extending therefrom, some combination thereof, or the like.

In exemplary embodiments, these scoring lines may permit players to actively track the score of the game. For example, without limitation, the scoring indicator may be moved along the score lines on the game board to correlate with the present score of the game. This scoring may be determined by the line or other numbering on the board, but such is not required. For example, placing the scoring indicator at the 20-yard line may be correlated with 2 points for the team. In one version of a bag toss game playable with the described game board, the lines may be provided in 5- or 10-yard line increments and the scoring indicator may be moveable by 5- or 10-yard line increments in relation to the 5- or 10-yard field lines (e.g., 5, 10, 15, 20, 25, etc.).

In other exemplary embodiments, these lines may provide scoring for the bag toss game playable with the board. For example, without limitation, where a bag comes to rest on the board, the corresponding line may determine the points associated with the toss. As a more specific example, without limitation, a toss landing on or about the 10-yard line may be associated with 1 point.

These are merely examples. Any type of correlation may be utilized. In other versions of a bag toss game associated with the board, no points correlating with lines are provided.

Further features and advantages of the systems and methods disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Various embodiments of the present invention will now be described in detail with reference to the accompanying Figures. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Embodiments of the invention are described herein with reference to illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Figure 1:
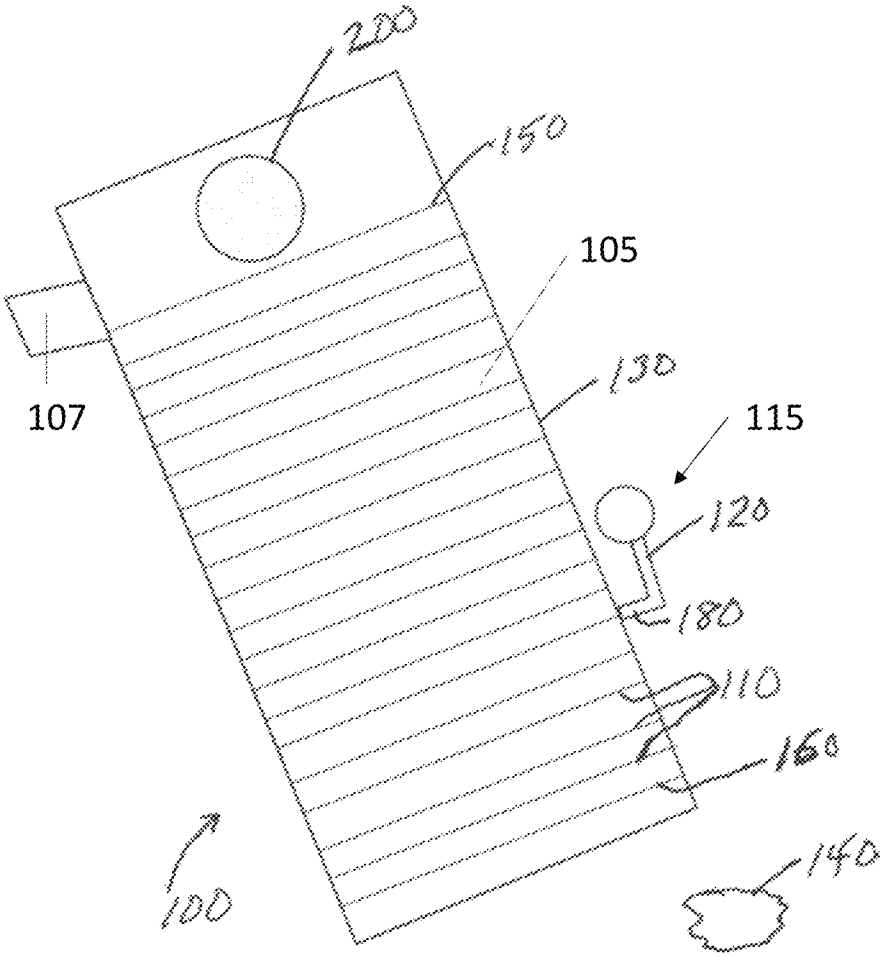
FIG. 1 is a perspective view of an exemplary bag toss game board with exemplary score lines and an exemplary scoring indicator attached to a side of the board in accordance with the present invention.

FIG. 1 is a perspective view of an exemplary bag toss game board 100. The board 100 may comprise a playing surface 105. The board 100 may comprise one or more side surfaces 130 which extend downward from the playing surface 105. In exemplary embodiments, the sides 130 extend about a perimeter of the playing surface 105 such that the board 100 forms a rectangular or cuboid shape with one side (e.g., the downward facing side) which remains open. In other exemplary embodiments, the sides 130 may comprise side surfaces of the playing surface 105, which may have a thickness.

Lines 110 may be provided at some of all of the playing surface 105. Such lines 110 may extend horizontally across the playing surface 105. For example, without limitation, the line 110 may extend parallel to top and bottom edges of the board 100. The lines 110 may be spaced apart from one another. The lines 110 may extend parallel to one another. The lines 110 may simulate field lines, such as but not limited to yard lines found on a football field. However, any arrangement, number, placement, size, and/or shape of lines 110 may be utilized to create any style, pattern, or effect. As further examples, without limitation, the lines 110 may be arranged to match another sporting field such as but not limited to, soccer, baseball, hockey, some combination thereof, or the like, or they may be arranged to form targets such as but not limited to circles, a bullseye, some combination thereof, or the like.

In other exemplary embodiments, the scoring lines 110 may be provided on one or more of the side surfaces 130. For example, without limitation, the lines 110 may be provided on a left-side, a right-side one, a top one, or a bottom one of the side surfaces 130, some combination thereof, or the like. Alternatively, or additionally, the scoring lines 110 may be provided on an upper, lower, or side of the playing surface 105.

A scoring indicator 115 may be provided. The scoring indicator 115 may be configured for selective attachment to each of a number of locations along the board 100. In exemplary embodiments, the scoring indicator 115 may be configured for selective attachment to at least one of the side surfaces 130 of the board 100. The scoring indicator 115 may comprise a post 120. The post 120 may be configured to extend above the playing surface 105, or other portion of the game board 100, when the scoring indicator 115 is secured to at the various locations.

For example, without limitation, when a player takes a turn tossing one or more bags 140 to the opponent's board 100, where the bags 140 land and come to rest on the board 100 may be equated to a certain point value. The scoring indicator 115 may be moved to a location adjacent a particular one of the lines 110 to reflect the current score for the team.

Alternatively, or additionally, the score value attributed may be relative to the lines 110. For example, without limitation, if a player's bag 140 comes to rest at a particular one of the lines 110 closest to the target hole 200 (designated in FIG. 1 as item 150), 5 points may be awarded to the player. The player may move their scoring indicator 115 to the 5-yard line to indicate 5 points. Another example, without limitation, is if the bag 140 came to rest on the first, most proximal one of the lines 110 (designated in FIG. 1 as item 160), 1 point may be awarded to the player tossing the bag 140. Any number of point values may be assigned to the equivalent or different line 110 on the board 100, such as agreed among the players or provided by game rules. In other exemplary embodiments, no points may be assigned to the lines 110 on the board 100. In this manner the game of the present invention may be played in multiple different scoring ways.

In an exemplary embodiment, like a football field, 21 major yard lines 110 may be provided at the board 100. For each 10, 20, 30, 40, 50, etc., yard line, a corresponding hole 170 may be provided which is configured to selectively receive the scoring indicator 115. In one exemplary scoring technique for a game associated with this embodiment, players may receive one point for each bag 140 the player lands on the board 100. For each point received, the scoring indicator 115 may be moved forward one score line 110 to indicate the increased score.

For example, without limitation, Team A Player 1 tosses a bag 140 which passes through a hole 200 in the board 100 (which may be scored, for example without limitation, as 3 points), two bags 140 which land and come to rest on the board 100 (which may be scored, for example without limitation, as 1 point each), and one bag 140 that misses the board 100 altogether. Team A Player 1 would then move its scoring indicator 115 ahead by four simulated yard lines 110 (representing a total of 4 points for that round). Another example, if Team A Player 1 landed all bags 140 on the board 100, Team A Player 1 would move the scoring indicator 115 ahead by four simulated yard lines 110 (representing 4 points for each of 4 bags left on the board). Any number, type, or combination of scoring approaches or points may be assigned to the game as the players so agree. Points may be assigned for tossing a bag 140 into the hole 200, and increasing points may be assigned for a bag 140 resting on or next to one of the lines 110 on the board 100, and in another embodiment of the invention point values may increase as the lines 110 get closer to the hole 200, or in yet another embodiment point values may be assigned for just landing a bag 140 on the playing surface 105. The lines 110 on the playing surface 105 may provide additional ways to play and score the game.

At least one leg 107 may be provided at the board 100. The leg 107 may be attached to a distal half of the board 100. The leg 107 may be configured to elevate the playing surface 105 at an angle relative to the ground. The leg 107 may be pivotally or otherwise moveably attached to the board 100. In exemplary embodiments, two legs 107 are provided along an upper edge of the board 100, though any number and location of such legs 107 may be utilized.

Figure 2:
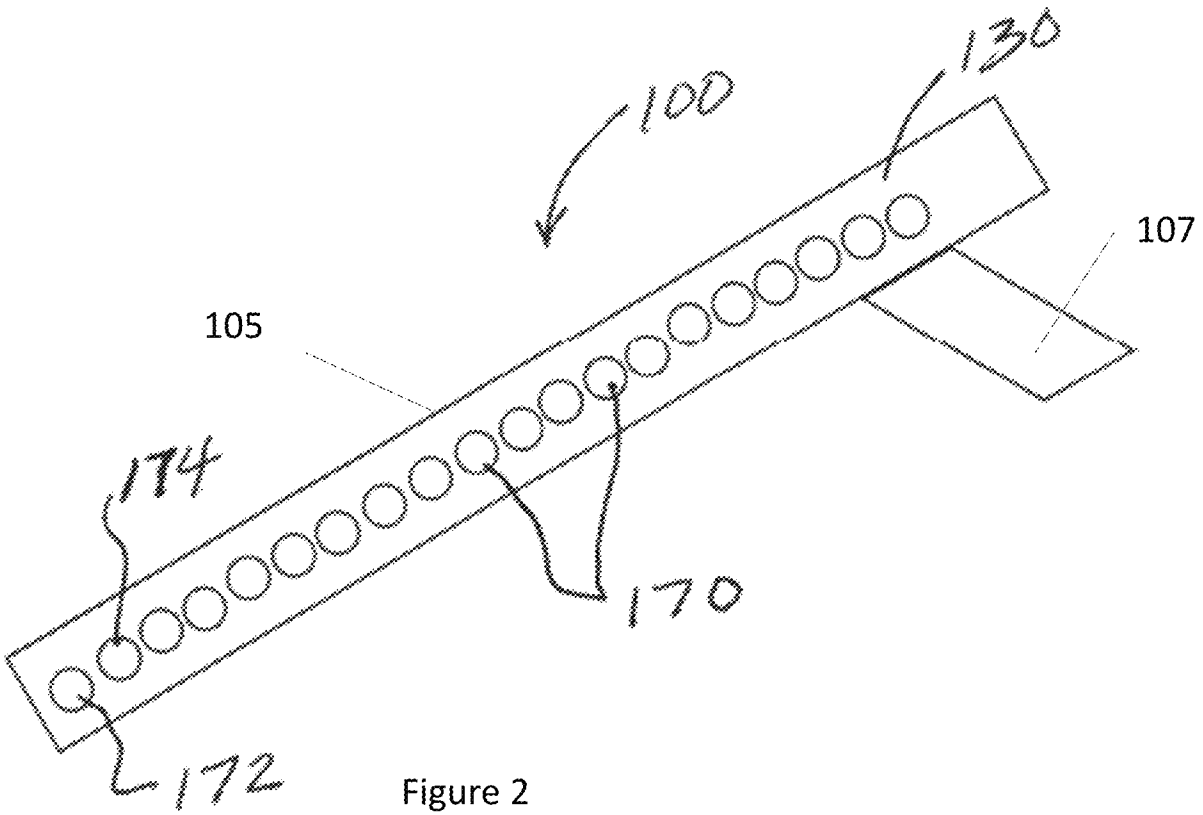
FIG. 2 is a side view of the board of FIG. 1 illustrating holes along the side for receiving the scoring indicator.

FIG. 2 is a side view of the bag toss game board 100 with hole inserts 170. In exemplary embodiments, holes 170 may be provided in one or more of the sides 130, at the playing surface 105, some combination thereof, or the like. One of the hole inserts 170, for example without limitation, may be provided in association with each of the lines 110. Each of the hole inserts 170 may be configured to receive the scoring indicator 115. The hole inserts 170 may be provided along the board 100 to correlate with the scoring lines 110. In this way, the scoring indicator 115 may be positioned adjacent the scoring line 110 reflecting the team's current score.

The hole inserts 170 may be spaced apart along substantially the length of the board 100. As each team scores more points, the scoring indicator 115 may be removed from a particular one of the hole inserts 170 (indicated in FIG. 2 as item 172) and inserted into another one of the insert holes 170 (indicated in FIG. 2 as item 174) further up the game board 100 to indicate the increase in total earned points for the team. In one exemplary embodiment 21 insert holes 170 may be provided on the right or left side surface 130 or other portion of the game board 100. The 21 holes 170 may represent 21 major yard lines 110 of a football field. Alternatively, or additionally, the 21 holes 170 may represent 21 total points for the team to score to win the game. However, the number and placement of the hole inserts 170 on the side 130 of the board 100 may vary. In another embodiment, only 10 holes 170 may be provided on the side 130 of the board 100. In such embodiments, for example without limitation, a team may be awarded one insert hole 170 advancement up the board 100 for each round of tosses in which that team had more points for the round than their opponent had in that round of tosses. The hole inserts 170 may comprise holes drilled into the side 130 of the board 100, inserts placed within the side 130 of the board 100, some combination thereof, or the like. Other devices for receiving the scoring indicator 115 may be utilized. The hole inserts 170 or other devices may be placed entirely or in part on other portions of the board 100.

Manual movement of the scoring indicator 115 up or down the board 100 may be permit players to track their progress and visually see how close their team is to winning the game. The scoring indicator 115 may be in the shape of, for example without limitation, a yard line marker, a flag, a pole, some combination thereof, or any other shape or configuration that can be easily removed from a hole insert 170 and placed in another hole insert 170 on the side 130 of the board 100. Once the scoring indicator 115 is placed in the most distal insert hole 170 (closest to the target hole in the board game surface) the game may be considered over and the team who first got their scoring indicator 115 to the final line insert hole 170 may be declared the winner, for example without limitation. In exemplary embodiments, the final insert hole 170 may be located relative to the lines 110 on the playing surface 105 such that the scoring indicator 115 is adjacent to an end zone of a simulated football field, such that placement within the end zone indicates that the team has won the bag toss game.

The scoring indicator 115 may comprise the post 120. The scoring indicator 115 may comprise a peg 180 extending from the post 120. The post 120 may extend vertically from the peg 180. Stated another way, the peg 180 may extend horizontally from the post 120. The peg 180 may be sized to fit in the insert holes 170. The peg 180 may comprise a material strong enough and durable enough to hold the scoring indicator 115 in place for many uses of the game over time. Many different types of extensions or pegs 180 may be used for the present invention, and they may comprise wood, metal, and/or durable hard plastic, or many other alternatives materials.

Figure 3:
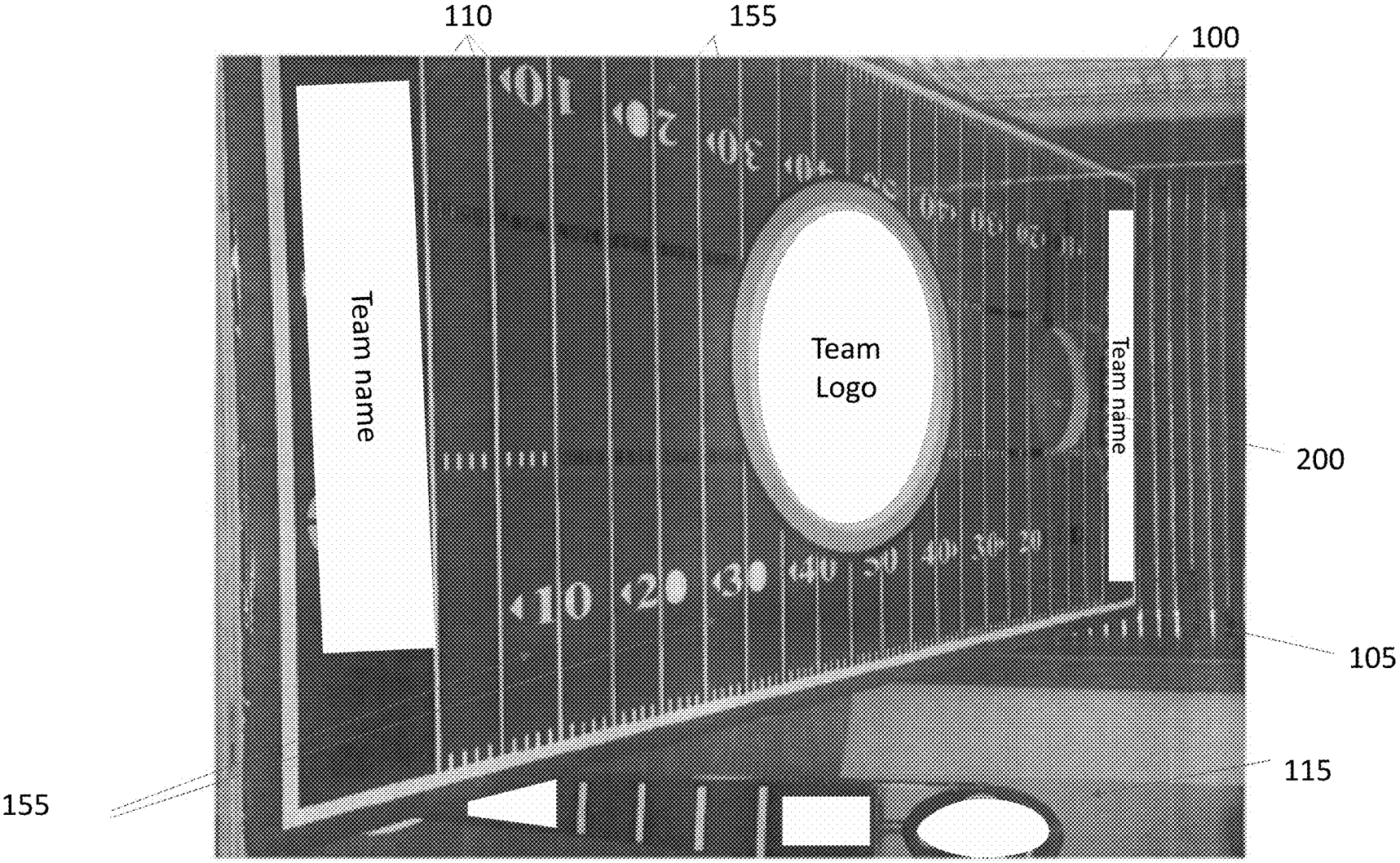
FIG. 3 is a perspective view of another exemplary embodiment of the present invention.

FIG. 3 illustrates an exemplary embodiment of the board 100. The yard lines 110 in the exemplary embodiment shown in FIG. 3 are in the image of an American style football field, however, in other exemplary embodiments the lines 110 may be arranged in a different manner with different spacing, shape, arrangement, thickness, length, and/or numbers. Furthermore, while the lines 110 in FIG. 3 are illustrated at the playing surface 105, the lines 110 may be, alternatively or additionally, provided on the side 130 of the board 100 rather than on the playing surface 105.

Numerical markings 155 may be provided in association with some or all of the lines 110. The numerical markings 155 may simulate yard line markings, represent a score, some combination thereof, or the like.

Team logos, names, or other insignia may be provided at the board 100.

In exemplary embodiments, the scoring indicator 115 may take the form of a yard marker, flag, post, peg, some combination thereof, or other shape or configuration.

Figure 4:
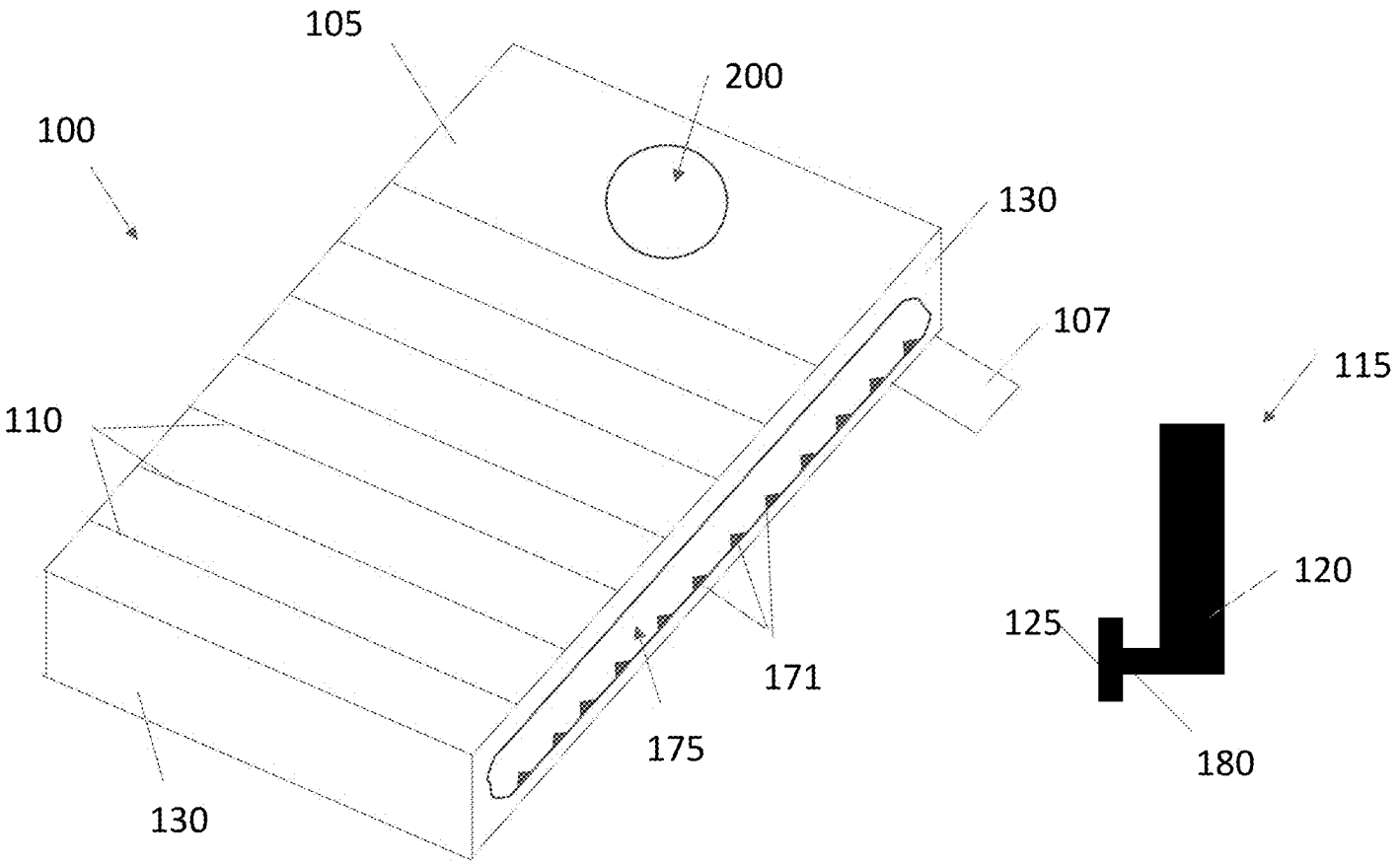
FIG. 4 is a perspective view of another exemplary embodiment of the present invention.

FIG. 4 illustrates a slot 175 which may be provided at the side 130 or other location of the board 100. The scoring indicator 115 may be configured for sliding movement up or down the slot 175 and thereby along the playing surface 105 of the board 100 to indicate player or team scoring progress. The scoring indicator 115 may comprise a protruded section 125 located at a distal end of the peg 180. The peg 180 may configured to fit within the slot 175. The protruded section 125 may be larger than an opening defined by the slot 175 to hold the scoring indicator 115 within the slot 175. The slot 175 may comprise protrusions or indentations 171 configured to frictionally engage the scoring indicator 115 such that said scoring indicator 115 may be selectively secured at a number of locations along the slot 175. In other exemplary embodiments, the tolerance between the scoring indicator 115 and the slot 175 may be sufficient to provide such frictional engagement.

Figure 5:
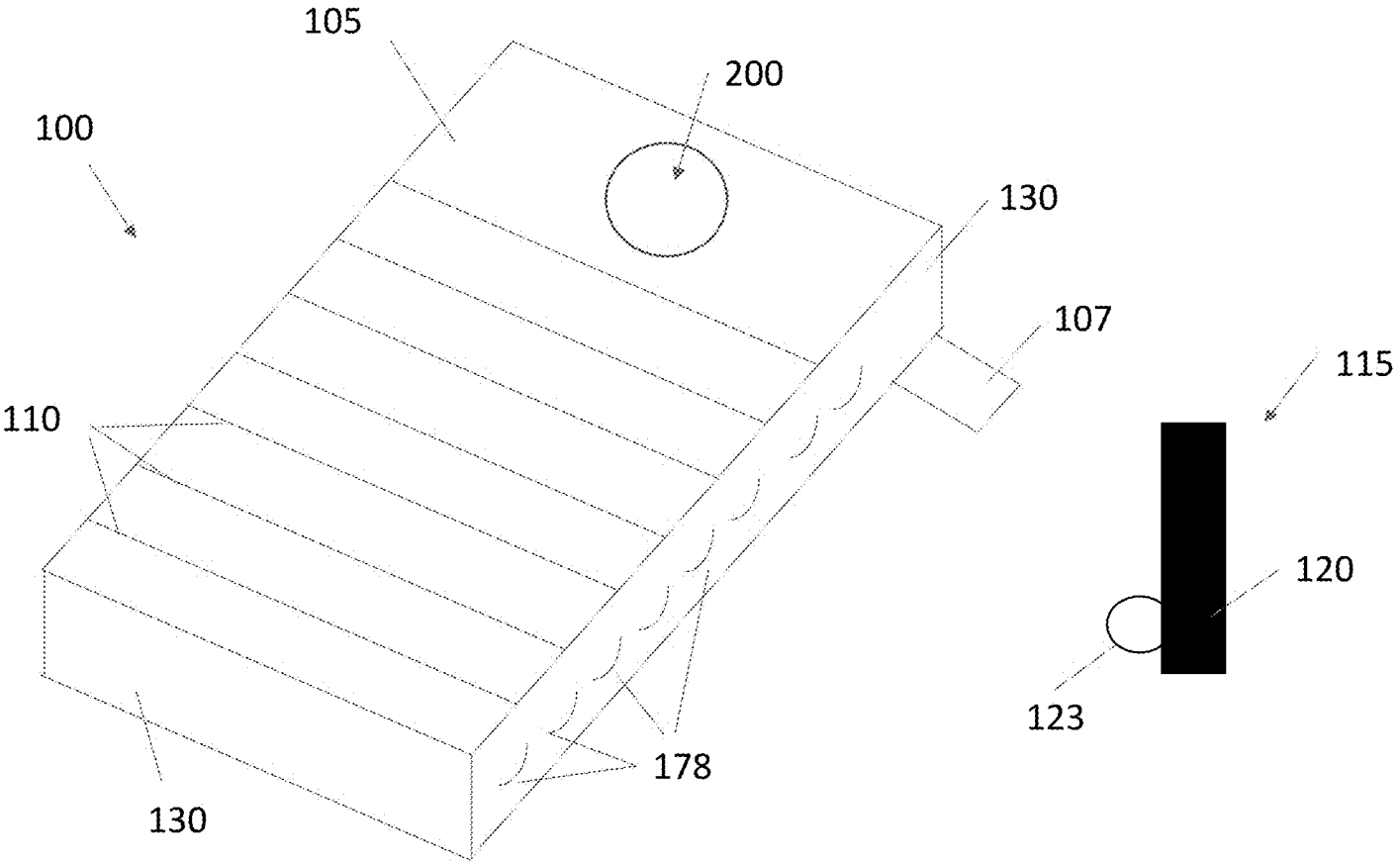
FIG. 5 is a perspective view of another exemplary embodiment of the present invention.

FIG. 5 illustrates a series of hooks 178 along the side 130 or other location of the board 100. The scoring indicator 115 may comprise a loop 123 or other device for securing said scoring indicator 115 to the hooks 178.

Figure 6:
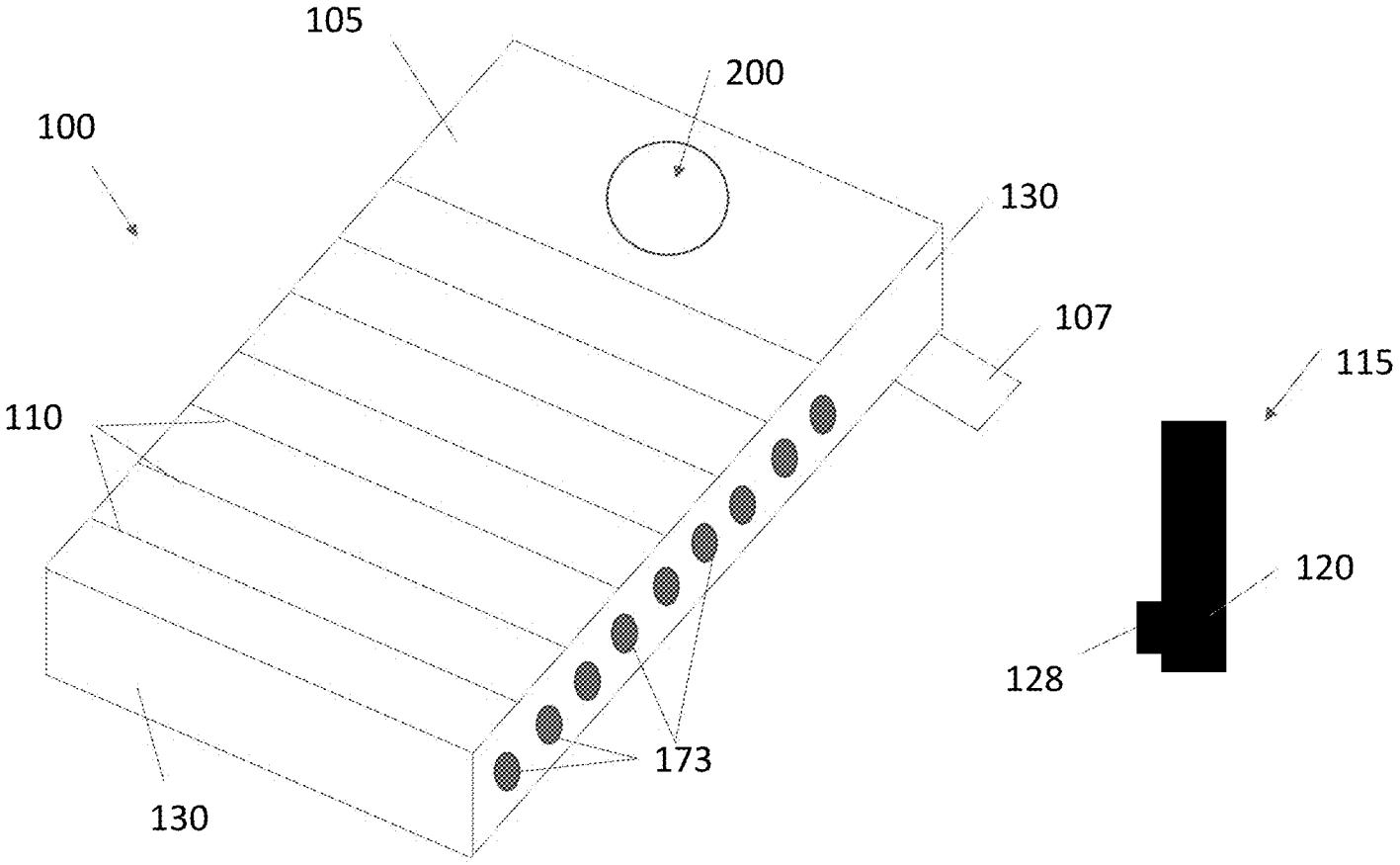
FIG. 6 is a perspective view of another exemplary embodiment of the present invention.

FIG. 6 illustrates a series of magnets 173 which may be spaced apart along the side 130 or other location of the board 100. The scoring indicator 115 may comprise a magnet 128 for attachment to the series of magnets 173. In other exemplary embodiments, the scoring indicator 115 may comprise a ferrous material portion 128, such as but not limited to certain metals, configured to be selectively secured to said magnets 173. In other exemplary embodiments, a magnetic rubberized strip may be utilized.

Many other examples of how to attach the scoring indicator 115 to the board 100 are possible and are included in the scope of the present invention.

Figure 7:
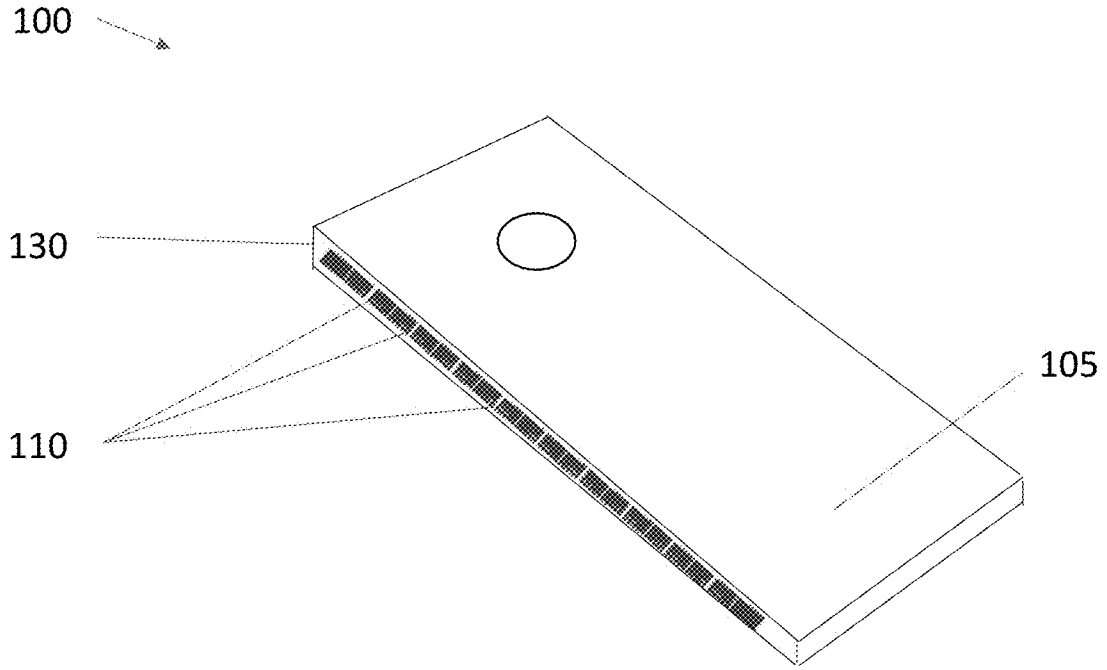
FIG. 7 is a perspective view of another exemplary embodiment of the present invention.
Figure 8:
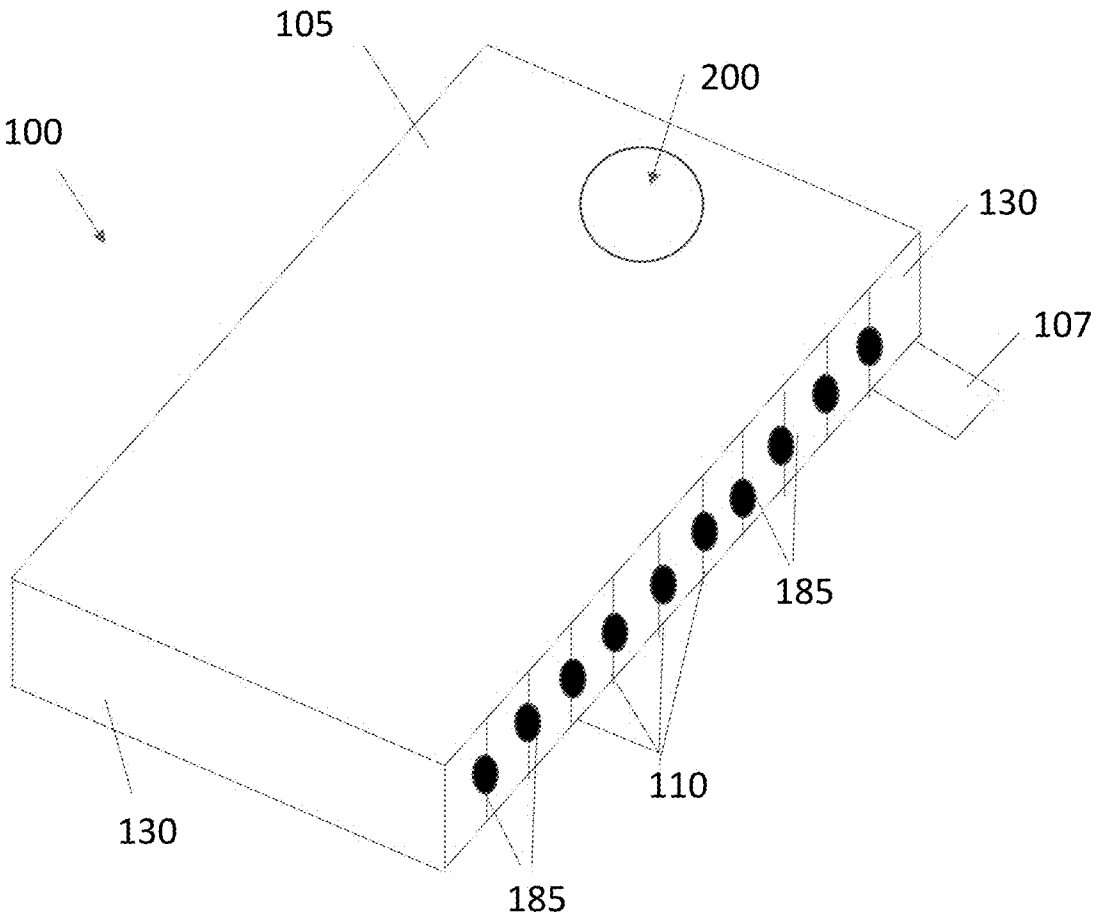
FIG. 8 is perspective view of another exemplary embodiment of the present invention.

FIG. 7 and FIG. 8 illustrate other exemplary embodiments of the board 100. As illustrated with particular regard to these figures, the scoring lines 110 may be located along a side edge 130 of the board 100. The scoring lines 110, in exemplary embodiments, may be located along the same side edge 130 of the board 130 as the attachment mechanism 185 for the scoring indicator 115, such as but not limited to, the holes 170, the hooks 178, the magnets 173, some combination thereof, or the like. In exemplary embodiments, each of the attachment mechanisms 185 may be provided in association with at least one of the scoring lines 110. For example, without limitation, each attachment mechanism 185 may be provided adjacent to, on, in the middle of, before, after, to the left of, to the right of, above, below, on top of, intersecting, some combination thereof, or the like, to a given one of the scoring lines 110.

The scoring lines 110 may be provide in addition to, or alternatively to, ornamental lines, insignia, or other markings provided at the playing surface 105, the side 130, some combination thereof, or the like. The scoring lines 110 may be printed, painted, or otherwise demarked on one more surfaces of the game board 110, provided as raised lines or inlays, some combination thereof, or the like.

Any embodiment of the present invention may include any of the features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A game board for playing a bag toss game having integrated score tracking and indicating features, said game board comprising:

a playing surface comprising a hole located at a distal half of the playing surface and sized to receive a bag tossed therethrough;

a side surface extending downward from said playing surface;

at least one leg attached to a distal half of the game board for angling the playing surface relative to a ground surface;

a scoring indicator comprising a peg extending in a first direction and a post extending in a second direction;

attachment mechanisms spaced apart along said side surface, wherein each of said attachment mechanisms is configured to receive, and temporarily secure, said scoring indicator; and a number of scoring lines provided at the playing surface, wherein each of said scoring lines are provided in linear alignment with one of said attachment mechanisms such that securement of said scoring indicator at said attachment mechanisms is configured to extend said peg in a horizontal direction and said post in a vertical direction to elevate said post above said playing surface to a location visibly aligned with a linear aligned one of said scoring lines to indicate a current score of said bag toss game.

2. The game board of claim 1 wherein:

each of said scoring lines are spaced apart from one another and extend parallel to one another to simulate yard lines on a football playing field.

3. The game board of claim 2 further comprising:

one or more ornamental lines provided at said playing surface.

4. The game board of claim 1 wherein:

each of said attachment mechanism comprise an insert hole.

5. The game board of claim 4 wherein:

said peg is configured to fit within said insert holes and said post extends perpendicular to the peg.

6. The game board of claim 5 wherein:

said scoring indicator comprises a flag located at an upper end of said post.

7. The game board of claim 6 further comprising:

a first side surface extending downward from a right-side edge of said playing surface;

a second side surface extending downward from a left-side edge of said playing surface;

a third side surface extending downward from a top edge of said playing surface; and a fourth side surface extending downward from a bottom edge of said playing surface, wherein said insert holes are spaced apart along one of the right-side surface or the left-side surface, wherein each of said insert holes are evenly spaced apart from one another in a linear fashion, and wherein each of said insert in holes are configured to receive the peg of said scoring indicator in a friction fit such that said scoring indicator is securable within the insert hole and the post of said scoring indicator is elevated above said playing surface to indicate points earned by a team by association with one of said scoring lines.

8. The game board of claim 7 further comprising:

numbering provided in association with at least some of the scoring lines to designate points earned by the team by placement of the scoring indicator adjacent to the numbering.

9. The game board of claim 1 further comprising:

a ferrous material located at said scoring indicator, wherein each of said attachment mechanisms comprise a magnet configured for magnetic attraction to said ferrous material.

10. The game board of claim 1 wherein:

said attachment mechanism comprises a slot located along said side surface; and said scoring indicator is configured to be receive within, and frictionally engage, said slot.

11. The game board of claim 1 further comprising:

a loop located at said scoring indicator, wherein each of said attachment mechanisms comprise a hook configured to receive said loop.

12. A method for playing a bag toss game, said method comprising the steps of: providing two game boards, each comprising: a playing surface comprising a hole located at a distal half of the playing surface and sized to receive a bag tossed therethrough; at least one leg attached to a distal half of the game board for angling the playing surface relative to a ground surface; a series of locations provided along a side surface which extends downward from said playing surface; a scoring indicator configured to be selectively received at each of said series of locations; and a series of scoring lines positioned along said playing surface, wherein each of said scoring lines are positioned adjacent to one of said locations, each of said scoring series of locations comprise a hole, and said scoring indicator comprise a first portion which extends laterally and is configured to be selectively received within each of said holes and a second portion which extends vertically and is configured to extend above said playing surface when said scoring indicator is received within one of said holes; tossing a number of bags at one of said two game boards to complete a round of play; determining a score for said round of play; and moving said scoring indicator to a particular one of said series of locations to indicate the score for said round of play.

13. The method of claim 12 wherein:

said scoring lines are provided at said side surface; and said scoring lines comprise 21 horizontal lines simulating yard lines of a regulation American football playing field.

14. The method of claim 13 wherein:

said two game boards each comprise numerical marking provided in association with at least some of said scoring lines; and said scoring indicator is placed adjacent to one of said scoring lines associated with one of said numerical markings corresponding to the score.

15. The method of claim 14 further comprising the steps of:

tossing the number of bags at a second of the two game boards to complete a second round of play;

determining a second score for said second round of play; and moving said scoring indicator to a second particular one of said series of locations to indicate a new total score for a team by adding the score from the round of play to the second scores from the second round of play.

16. The method of claim 15 further comprising the steps of:

declaring a winning team when said scoring indicator reaches a final one of said locations.

17. A game board for playing a bag toss game having integrated score tracking and indicating features, said game board comprising:

a playing surface which is planar and comprises a hole located at a distal half of the playing surface and sized to receive a bag tossed therethrough;

a series of side surfaces located about a perimeter of said playing surface and extending downward from said playing surface towards a ground surface;

at least one leg attached to a distal half of the game board for propping the playing surface at an angle relative to the ground surface;

a simulated football field located at said playing surface and comprising scoring lines spaced apart and extending to at least one of said series of side surfaces; and a series of insert holes spaced apart in a linear fashion on said at least one of said series of side surfaces, wherein each of said insert holes are located adjacent to one of said scoring lines;

numerical markers provided adjacent to each of said scoring lines; and a scoring indicator for indicating a current score, said scoring indicator comprising:

a peg configured to be received, one at a time, within each of said series of holes in a friction fit; and a simulated yard marker comprising a flag configured to extend above said playing surface when said peg is inserted into any particular one of said series of holes.

* * * * *